United States Patent [19]

Johnson

[11] Patent Number: 5,029,867

[45] Date of Patent: Jul. 9, 1991

[54] GOLF GAME

[76] Inventor: William C. Johnson, 9110 Shoal Creek, Houston, Tex. 77064

[21] Appl. No.: 626,750

[22] Filed: Dec. 13, 1990

[51] Int. Cl.[5] ..... A63B 69/36

[52] U.S. Cl. ..... 273/181 A; 273/182 R; 273/184 R; 273/181 D

[58] Field of Search ..... 273/181 R, 181 A, 181 D, 273/191 F, 181 G, 181 H, 181 K, 182 R, 182 A, 184 R, 185 R

[56] References Cited

U.S. PATENT DOCUMENTS 2,936,179 5/1960 Thurston ..... 273/182 R
3,889,957 6/1975 Klabacka ..... 273/182 R
4,281,834 8/1981 Chavez ..... 273/182 R

*Primary Examiner*—George J. Marlo
*Attorney, Agent, or Firm*—Michael I. Kroll

[57] ABSTRACT

An improved golf game device is proivded and consists of a funnel shaped trough including a soft liner carried in an open topped housing to receive a golf ball hit by a golf player. A return chute having an exit port is connected to the bottom of the trough with the exit port extending from the housing. A mechanism within the housing will indicate that the golf ball has been received ion the trough and is carried back onto a driving range. The housing contains carry handles on opposite sides thereof and wheels on its lower end which facilitate moving the device along the driving range.

4 Claims, 2 Drawing Sheets

Fig. 4
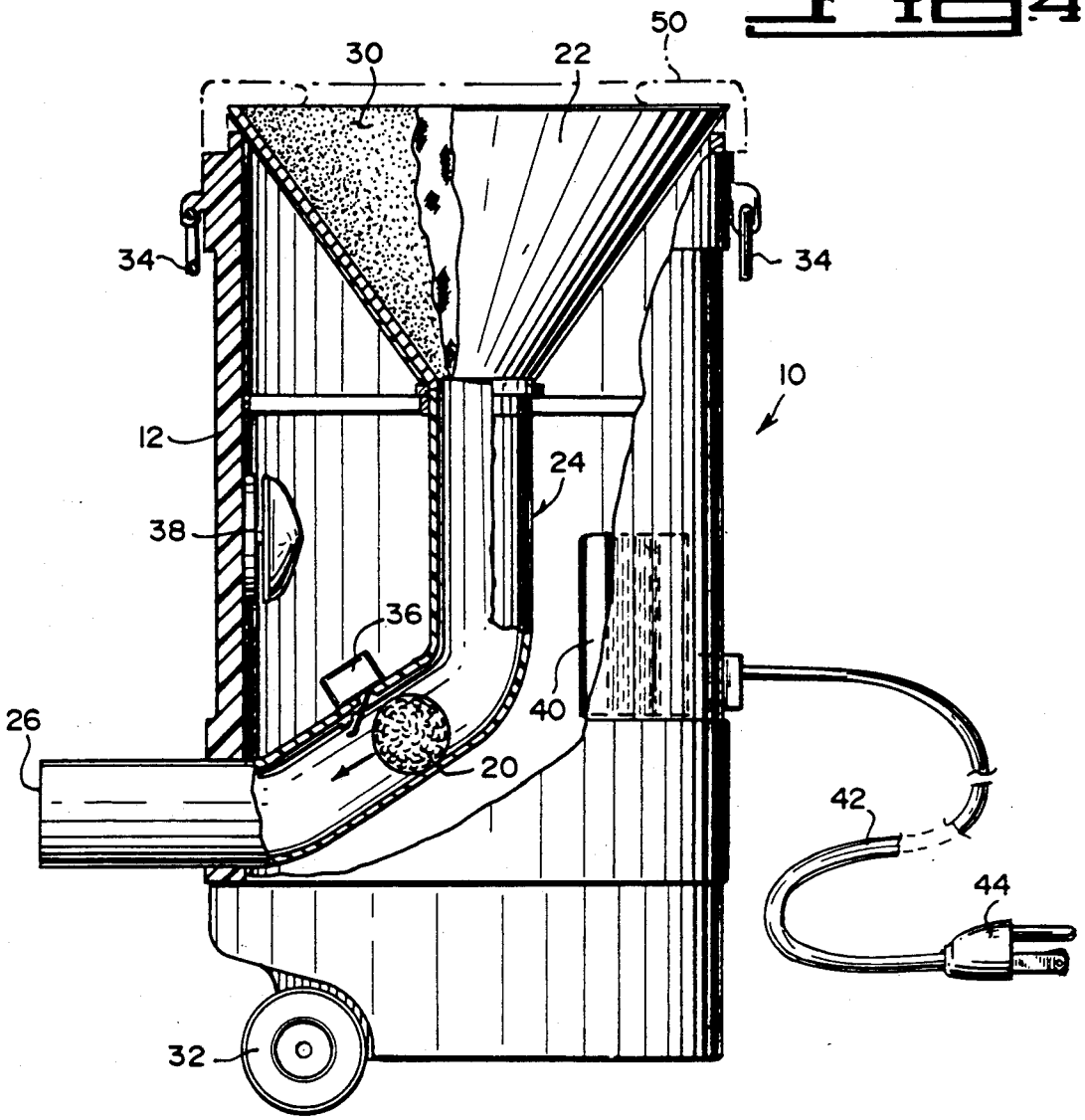
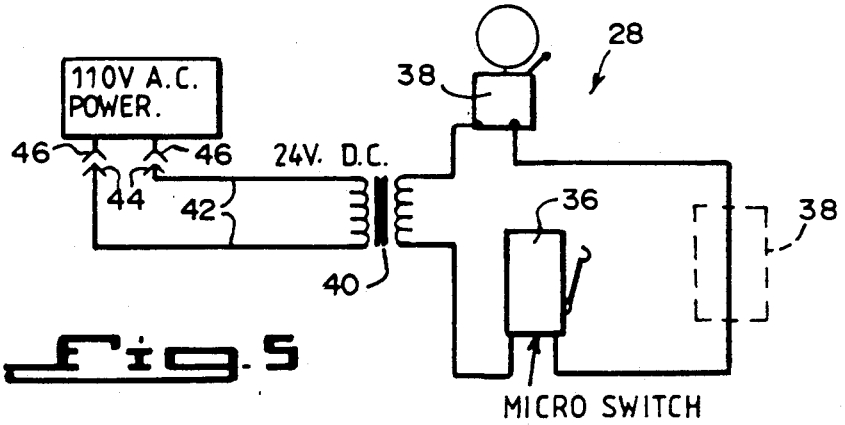
Fig. 5

GOLF GAME

BACKGROUND OF THE INVENTION

1. Field of the Invention

The instant invention relates generally to golf equipment and more specifically it relates to an improved golf game device.

2. Description of the Prior Art

Numerous golf equipment have been provided in prior art that are adapted to help golf players enhance their playing of the game of golf. While these units may be suitable for the particular purpose to which they address, they would not be as suitable for the purposes of the present invention as heretofore described.

SUMMARY OF THE INVENTION

A primary object of the present invention is to provide an improved golf game device that will overcome the shortcomings of the prior art devices.

Another object is to provide an improved golf game device that will help a golf player improve their chip shots during the play of the game.

An additional object is to provide an improved golf game device that will indicate by an audio alarm that a ball hit by the golf player is received into the housing of the device.

A further object is to provide an improved golf game device that is simple and easy to use.

A still further object is to provide an improved golf game device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 4 is a side elevational view taken in direction of arrow 4 in FIG. 3 with parts broken away and in section.

FIG. 5 is a schematic view of the electrical circuitry of the instant invention.

DETAILED DESCRIPTION OF THE PREFERRED EMBODIMENTS

Figure 1:
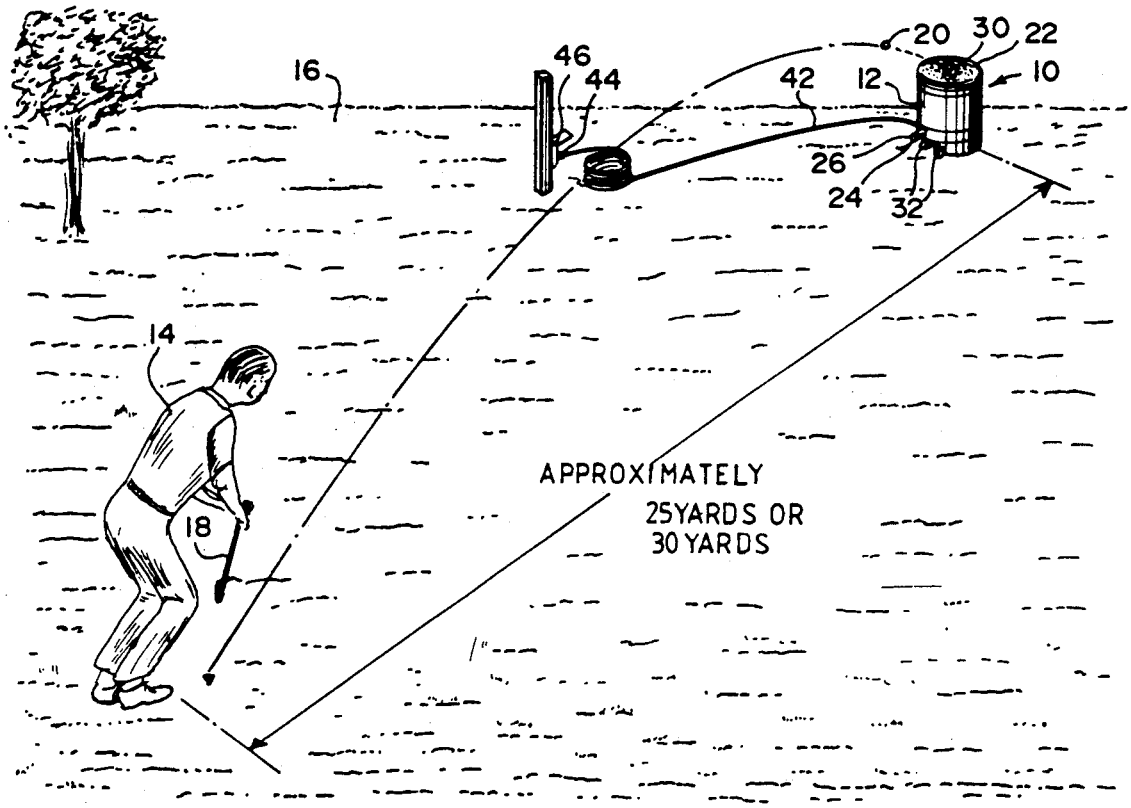
FIG. 1 is a perspective view of the instant invention being used on a golf driving range.
Figure 2:
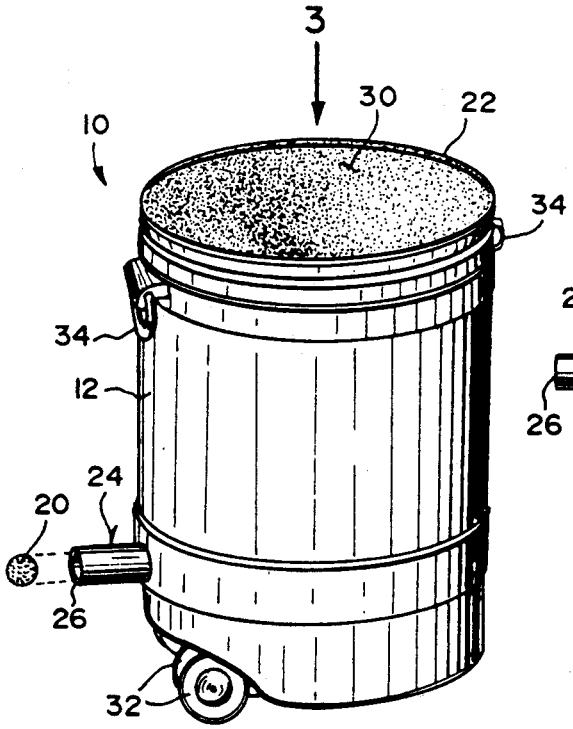
FIG. 2 is an enlarged perspective view of just the instant invention.
Figure 3:
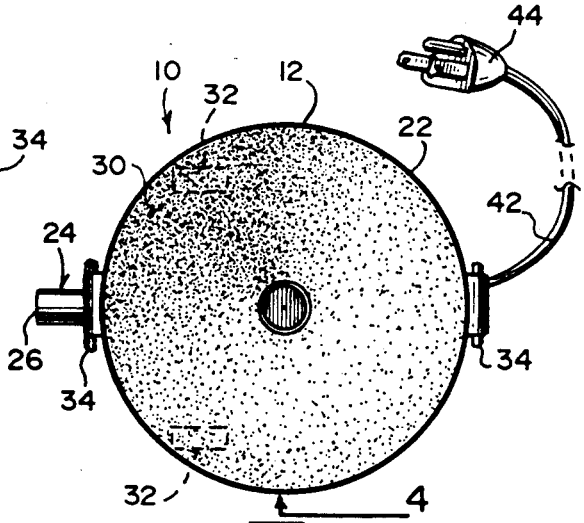
FIG. 3 is a top view taken in direction of arrow 3 in FIG. 2.

Turning now descriptively to the drawings, in which similar reference characters denote similar elements throughout the several views, The Figures illustrate an improved golf game device 10 consisting of an open topped housing 12 to be placed a predetermined distance away from a golf player 14 on a driving range 16, so that the golf player 14 will swing a golf club 18 to hit a golf ball 20 into the housing 12. A funnel shaped trough 22 is carried in the open toped housing 12 to receive the golf ball 20 hit by the golf player 14. A return chute 24 having an exit port 26 is connected to the bottom of the trough 22. The exit port extends from one side of the housing 12, so as to carry the golf ball 20 from the trough 22 out through the exit port 26 back onto the driving range 16. A mechanism 28 within the housing 12 is for indicating that the golf ball 20 has been received in the trough 22 and carried back onto the driving range 16.

A carpet liner 30 is provided in the trough 22 to soften the blow of the golf ball 20 so that the golf ball will not bounce out of the trough 22. A pair of wheels 32 are pivotally carried on the bottom of the housing 12. A pair of carry handles 34 are each on an opposite side of the housing 12 so that the handles 34 can be gripped and the housing 12 moved along the driving range 16 on the wheels 32.

The indicating mechanism 28 includes a micro switch 36 on the return chute 24 to be activated by the passing through of the golf ball 20. An audio alarm 38, such as a bell or the like, is carried in the housing 12 and electrically connected to the micro switch 36. A transformer 40 is carried in the housing 12 and is electrically connected between the micro switch 36 and the audio alarm 38. An elongated electrical cord 42 is connected to the transformer 40. A plug 44 is carried on the distal end of the cord 42 and is inserted into a weatherproof socket 46 on the driving range 16 to supply electrical power so that when the golf ball 20 enters the return chute 24 the micro switch 36 will momentarily close to activate the audio alarm 38 to indicate to the golf player 14 that the golf ball 20 was received into the device 10.

The indicating mechanism 28 can also include a timer delay circuit 38 electrically connected between the micro switch 36 and the audio alarm 38 to keep the audio alarm 38 on for a predetermined amount of time when the micro switch 36 is momentarily closed by the passing of the golf ball 20 through the return chute 24.

A collar 50, shown in phantom in FIG. 4, can also be provided to fit upon the open top housing 12 to reduce the area of the trough 22 so as to help keep the golf ball 20 from rolling out of the trough 22 when the golf ball 20, hit by the golf club 18 enters the device 10.

A game can be played with the device 10 in which the golf player 14 who makes the highest score can receive a prize or cash award. This will help each golf player 14 improve their chip shots around the greens on a golf course.

LIST OF REFERENCE NUMBERS

10: improved golf game device
12: open topped housing
14: golf player
16: driving range
18: golf club
20: golf ball
22: funnel shaped trough
24: return chute
26: exit port of 24
28: indicating mechanism
30: carpet liner
32: wheel
34: carry handle
36: micro switch
38: audio alarm
40: transformer
42: electrical cord
44: plug
46: weatherproof socket 48: time delay circuit 50: collar.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved golf game device comprising:

(a) an open topped housing to be placed a predetermined distance away from a golf player on a driving range, so that the golf player will swing a golf club to hit a golf ball into the housing;

(b) a funnel shaped trough carried in the open topped housing to receive the golf ball hit by the golf player;

(c) a return chute having an exit port, said chute connected to the bottom of the trough with the exit port extending from one side of the housing so as to carry the golf ball from the trough out through the exit port back onto the driving range;

(d) means within said housing for indicating that the golf ball has been received in said trough and carried back onto the driving range;

(e) a soft liner in said trough to soften the blow of the golf ball so that the golf ball will not bounce out of said trough;

(f) a collar to fit upon said open topped housing to reduce the area of said trough, to help keep the golf ball from rolling out of said trough when the golf ball hit by the golf club enters said device;

(g) a pair of wheels pivotally carried on the bottom of said housing; and (h) a pair of carry handles, each on an apposite side of said housing so that said handles can be gripped and said housing moved along the driving range on said wheels.

2. An improved golf game device as recited in claim 1, wherein said indicating means includes:

(a) a micro switch on said return chute to be activated by the passing through of the golf ball;

(b) an audio alarm carried on said housing and electrically connected to said micro switch;

(c) a transformer carried in said housing and electrically connected between said micro switch and said audio alarm;

(d) an elongated electrical cord connected to said transformer; and (e) a plug carried on the distal end of said cord to be inserted into a weatherproof socket on the driving range to supply electrical power so that when the golf ball enters said return chute said micro switch will momentarily close to active said audio alarm to indicate to the golf player that the golf ball was received into said device.

3. An improved golf game device as recited in claim 2, wherein said indicating means further includes a time delay circuit electrically connected between said micro switch and said audio alarm to keep said audio alarm on for a predetermined amount of time when said micro switch is momentarily closed by the passing of the golf ball through said return chute.

4. An improved golf game device as recited in claim 3, wherein said audio alarm is a bell.

* * * * *